US006340882B1

(12) United States Patent
Chung et al.

(10) Patent No.: US 6,340,882 B1
(45) Date of Patent: Jan. 22, 2002

(54) ACCURATE CURRENT SOURCE WITH AN ADJUSTABLE TEMPERATURE DEPENDENCE CIRCUIT

(75) Inventors: Paul W. Chung; John T. Contreras, both of San Jose, CA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/678,563

(22) Filed: Oct. 3, 2000

(51) Int. Cl.[7] ..... G05F 3/16
(52) U.S. Cl. ..... 323/315; 323/314; 327/539
(58) Field of Search ..... 323/313, 314, 323/315, 316, 317; 330/257, 288; 327/530, 534, 535, 538, 539

(56) References Cited

U.S. PATENT DOCUMENTS 5,038,053 A * 8/1991 Djenuerian et al. ..... 307/310
5,352,973 A * 10/1994 Audy ..... 323/313
5,796,244 A * 8/1998 Chen et al. ..... 323/313
6,046,578 A * 4/2000 Feldtkeller ..... 323/314
6,184,670 B1 * 2/2001 Mulatti et al. ..... 323/314

* cited by examiner

*Primary Examiner*—Matthew Nguyen
(74) *Attorney, Agent, or Firm*—James C. Pinter; Jon A. Gibbons; Fleit, Kain, Gibbons, Gutman & Bongini P.L.

(57) ABSTRACT

An accurate current source with an adjustable temperature dependence. This type of current source is used in silicon Integrated Circuit (IC) designs requiring supporting reference-voltage sources and/or reference-current sources which may be designed with or without temperature dependence. The circuit generates an accurate current with temperature independence along with another accurate current source with temperature dependence using only one precision external resistors. For the temperature-dependent current source, the temperature dependence can be controlled by setting a temperature dependence factor (TDF).

12 Claims, 5 Drawing Sheets

PRIOR ART 100

ACCURATE CURRENT SOURCE WITH AN ADJUSTABLE TEMPERATURE DEPENDENCE CIRCUIT

CROSS-REFERENCE TO RELATED APPLICATIONS

Not Applicable

BACKGROUND OF THE INVENTION

1. Field of the Invention

This invention broadly relates to analog and digital circuits requiring a reference voltage and more particularly relates to improvements in temperature dependent and temperature independent integrated circuits requiring a reference voltage.

2. Description of the Related Art

In analog integrated circuit (IC) designs there are temperature-dependent parameters in silicon devices such as bipolar transistors, field effect transistors (FET), diffusion resistors and poly-silicon resistors. Some circuit topologies are designed to cancel these temperature dependencies, but other circuit topologies have an inherent temperature dependence that is only canceled by a bias circuit. A bias circuit is controlled by a current or voltage source. These current or voltage sources are designed to have temperature dependence or temperature independence. There are applications where these sources are required to be accurate, and to have this accuracy, the bias circuit then requires either an external resistor or an internal trimmed resistor.

FIG. 1 is a prior art bandgap reference circuit (100) that generates an accurate bias current source which in turn is used to generate an accurate reference voltage, $V_{BG}$. The accurate bias-current, $I_{acc.}$, source is generated when using an accurate resistor, $R_{ext.}$, a resistor which is typically external to the IC. The following equation is for the accurate current source $I_{acc}$.

Equation 1:

$$I_{acc.} = \frac{V_{BE} + \frac{2R_2V_T\ln(n)}{R_1}}{R_{ext.}}$$

The voltage, $V_{BE}$, has a negative temperature coefficient while the thermal voltage, $V_T$, has a positive temperature coefficient. Therefore, the ratio of $R_1$ and $R_2$ can be set so that the positive and negative coefficients cancel, thereby making the accurate current, $I_{acc.}$, become temperature independent. On the other hand, the ratio of $R_1$ and $R_2$ can be set to favor either the positive or negative correlation, thereby making the accurate current become temperature dependent.

Since these two cases are mutually exclusive, an IC design ordinarily requires two external resistors: one external resistor for an accurate current source with temperature dependence; and a second external resistor for an accurate current source with temperature independence. In other words, all prior reference circuits can not generate an accurate current with temperature independence along with another accurate current source with temperature dependence. Because of this, all prior reference circuits require two precision external resistors (PERs); one for temperature independence and another for temperature dependence. Although the use of two PERs is useful, the use of two PERs does have its shortcomings, one short coming with the additional external component adds to the costs. Therefore, there is a need for an IC design that avoids the limitations of the prior art requirement of two external resistors to provide both temperature dependent and temperature independent circuits.

Another shortcoming with the use of two PERs is the resulting increase in physical size of the IC. IC designers strive to keep component count and component size to a minimum. Accordingly, a need exists for an IC design that overcomes the use of two PERs to provide both temperature dependent and temperature independent circuits. Accordingly, a need exists to eliminate the need for two external resistors and to provide a solution that uses only one PER to produce two accurate current sources: one accurate current source with temperature independence; and second accurate current source with temperature dependence.

SUMMARY OF THE INVENTION

Briefly, in accordance with the invention, disclosed is an accurate current source with an adjustable temperature dependence circuit. This type of accurate current source is used in silicon Integrated Circuit (IC) designs requiring supporting reference-voltage sources and or reference-current sources which may be designed with or without temperature dependence. The circuit generates an accurate current source with temperature independence along with another accurate current source with temperature dependence using only one precision external resistor. For the temperature-dependent current source, the temperature dependence can be controlled by setting a temperature dependence factor (TDF).

BRIEF DESCRIPTION OF THE FIGURES

The subject matter which is regarded as the invention is particularly pointed out and distinctly claimed in the claims at the conclusion of the specification. The foregoing and other objects, features, and advantages of the invention will be apparent from the following detailed description taken in conjunction with the accompanying drawings.

DETAILED DESCRIPTION OF THE PREFERRED EMBODIMENTS

Figure 1:
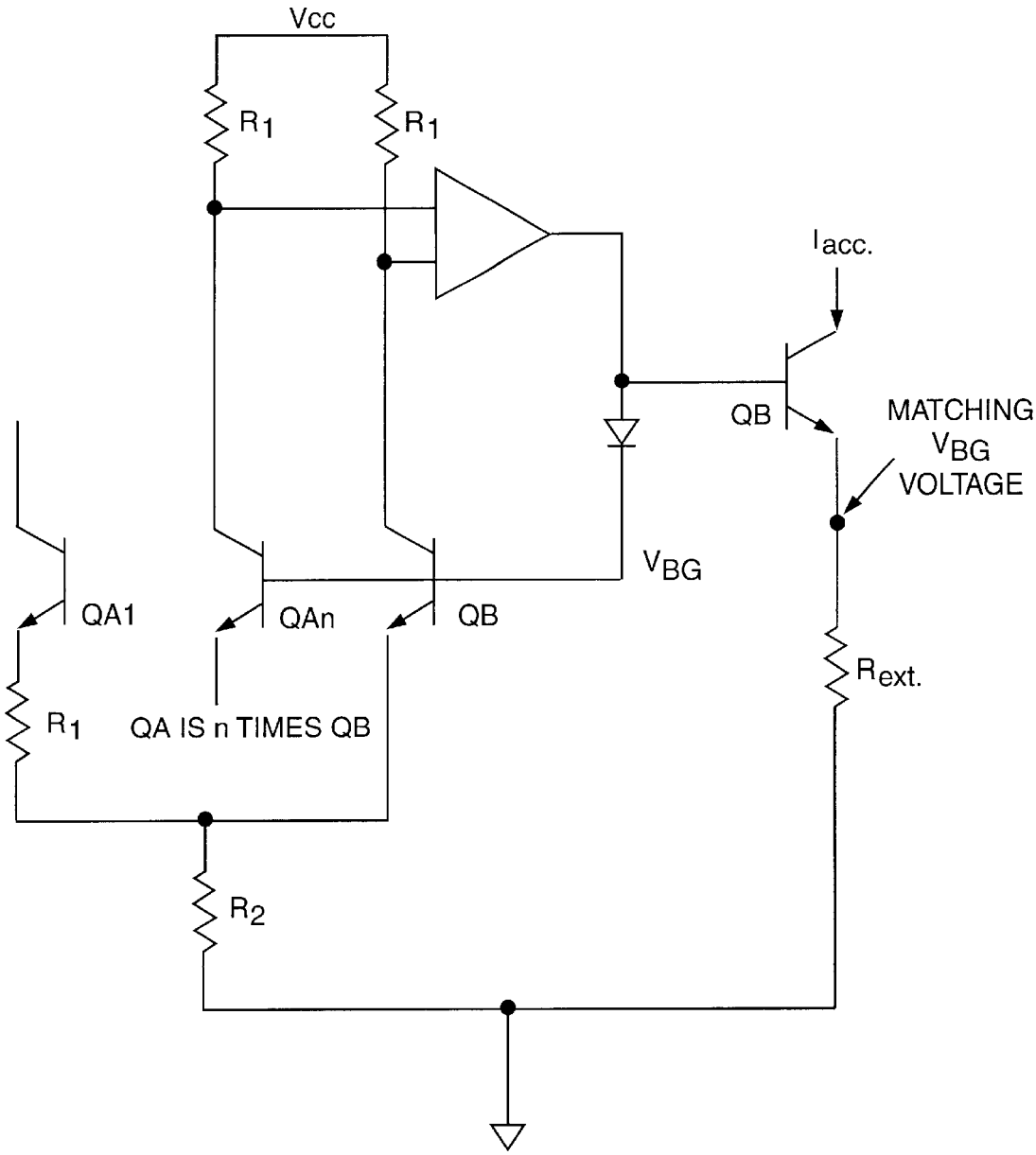
FIG. 1 is a prior art bandgap reference circuit that generates an accurate bias current source.

It is important to note that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality.

In the drawing like numerals refer to like parts through several views.

Exemplary Embodiment-an Accurate Temperature Dependent Current Source

This invention utilizes an accurate temperature independent current source to produce an accurate temperature dependent current source, where the current dependence is controlled. As stated in Equation 1 above, an accurate current source produces a current, $I_{acc.}$, which is derived from a bandgap reference voltage, Equation 2:

$$V_1 = V_{BE} + \frac{2R_2V_T\ln(n)}{R_1}$$

and an accurate resistor, $R_{ext.}$.

Figure 2:
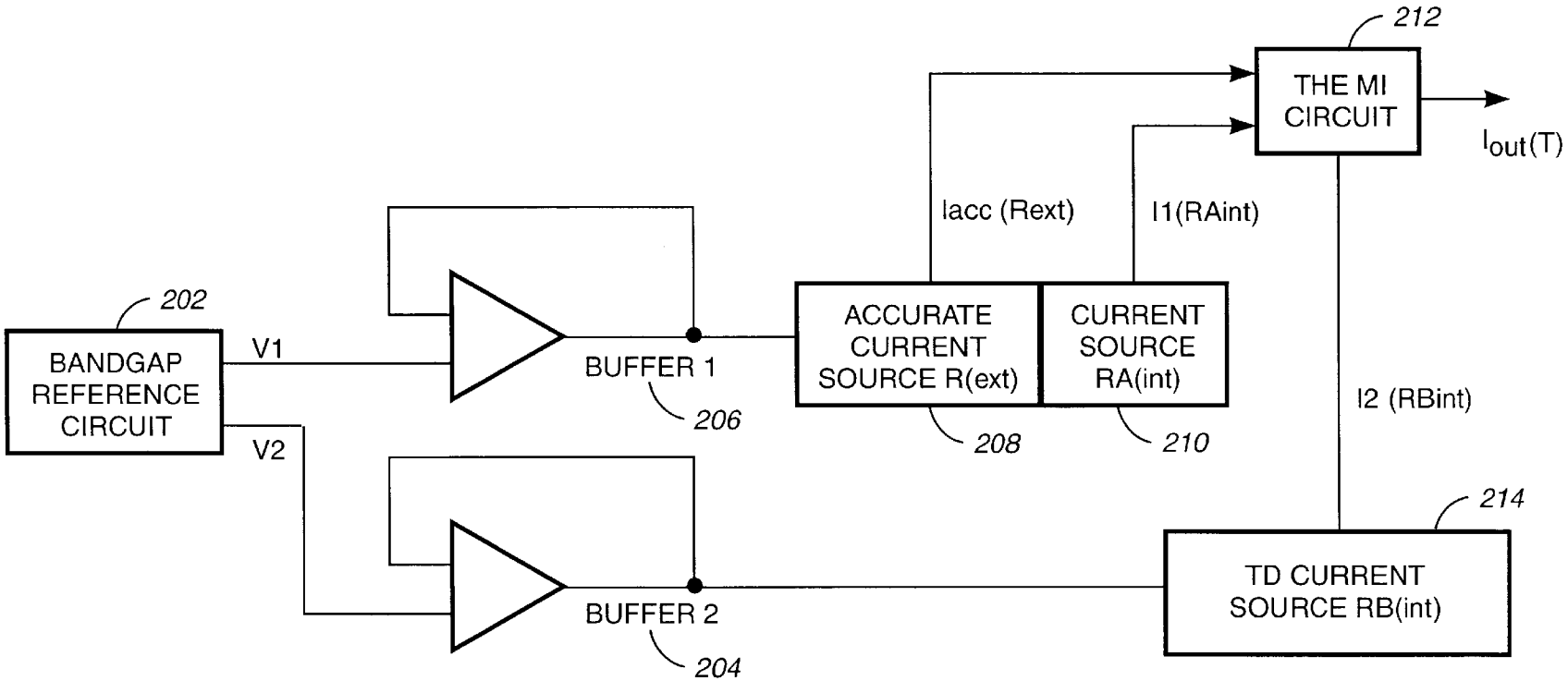
FIG. 2 is a block diagram of the architecture used to generate an accurate temperature dependent current source according to this invention.

FIG. 2 is a block diagram (200) of the architecture used to generate an accurate temperature dependent current source according to this invention. In FIG. 2, the accurate current source (208) is temperature independent. Similarly as for $I_{acc.}$, a current source (210) produces a current $I_1$ which is generated to be dependent on an internal resistor, $RA_{int}$ and independent of temperature. Typically, internal resistors are inaccurate and add a significant amount of variation, that is 15% to 25% in tolerance. As shown in FIG. 2, the amplifier buffers (204,206), typically a single-rail operational type amplifier, are designed to isolate the bandgap reference circuit from the current generating circuits.

Figure 3:
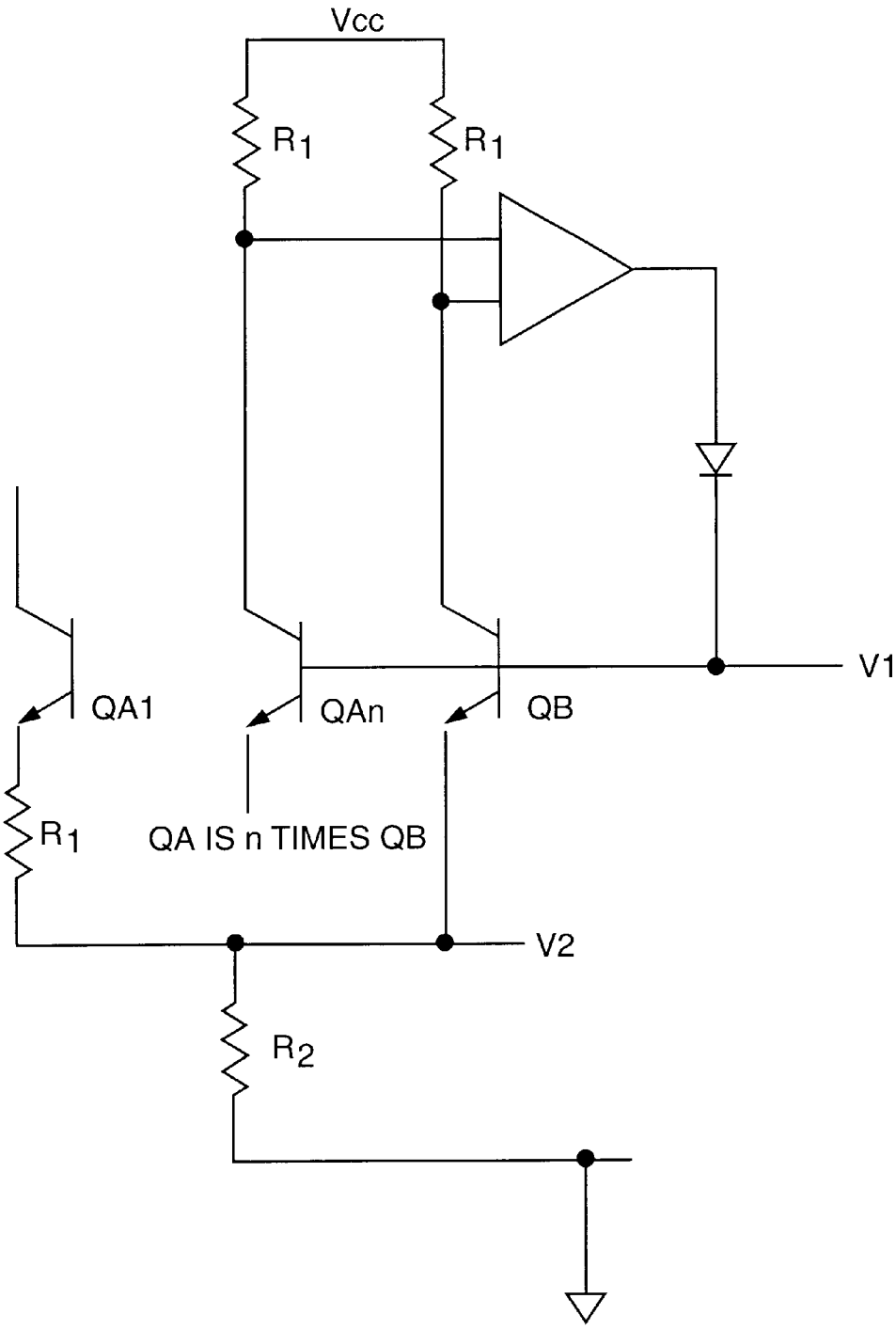
FIG. 3 is the bandgap reference circuit shown utilizing the voltages $V_1$ and $V_2$.

Here, a voltage from the bandgap reference circuit (202), $V_2$, is an accurate temperature dependent voltage source. FIG. 3 shows the details of the Bandgap Reference circuit (202) with the utilized voltages $V_1$ and $V_2$. The voltage $V_2$ is defined as the bandgap reference voltage, Equation 2, minus the $V_{BE}$ voltage. Therefore the equation for $V_2$ is as follows:

Equation 3:

$$V_2 = \frac{2R_2V_T\ln(n)}{R_1} \quad \text{where:} \quad V_T = k\frac{T}{q}$$

From FIG. 2, the current source (214) produces a current $I_2$ which is dependent on both temperature and an internal resistor, $RB_{int.}$. Although, internal resistors have a significant amount of tolerance and variation, internal resistors of the same type (e.g., polysilicon or diffusion type) track well. Typically, the tracking tolerance for such internal resistors can be close to 2%.

Further, the multiplication and inversion (MI) circuit (212) is designed to perform a multiplication and inverse to its input currents ($I_{acc.}$, $I_1$, and $I_2$), as shown in Equation 4:

Equation 4:

$$I_{OUT} = \frac{I_{acc.}I_2}{I_1}$$

As discussed earlier, the current $I_{acc.}$is an accurate current source, and for the $I_1$ and $I_2$ currents, the inaccuracies caused by the internal resistors $RA_{int.}$and $RB_{int.}$ are canceled out by the division, shown in Equation 4, and the resistors being of the same type. As mentioned before, resistors of the same type have an accurate tracking tolerance. In addition, because the current $I_2$ has a known temperature dependence, $I_{OUT}$ is an accurate and temperature-dependent current source.

By combining Equations 2, 3, and 4, the following expression results for $I_{OUT}$.

Equation 5:

$$I_{OUT} = \frac{\frac{V_1}{R_{ext.}}\frac{V_2}{R_B}}{\frac{V_1}{R_A}} = \frac{2kTR_2R_A\ln(n)}{qR_1R_BR_{ext.}}$$

Equation 5 shows that the variations of the internal resistors (R1, R2, RA, RB) cancel because of the relatively good tracking tolerance. Therefore, $I_{OUT}$ is only dependent on the temperature, T, and the known constants n, k, and q.

Figure 4:
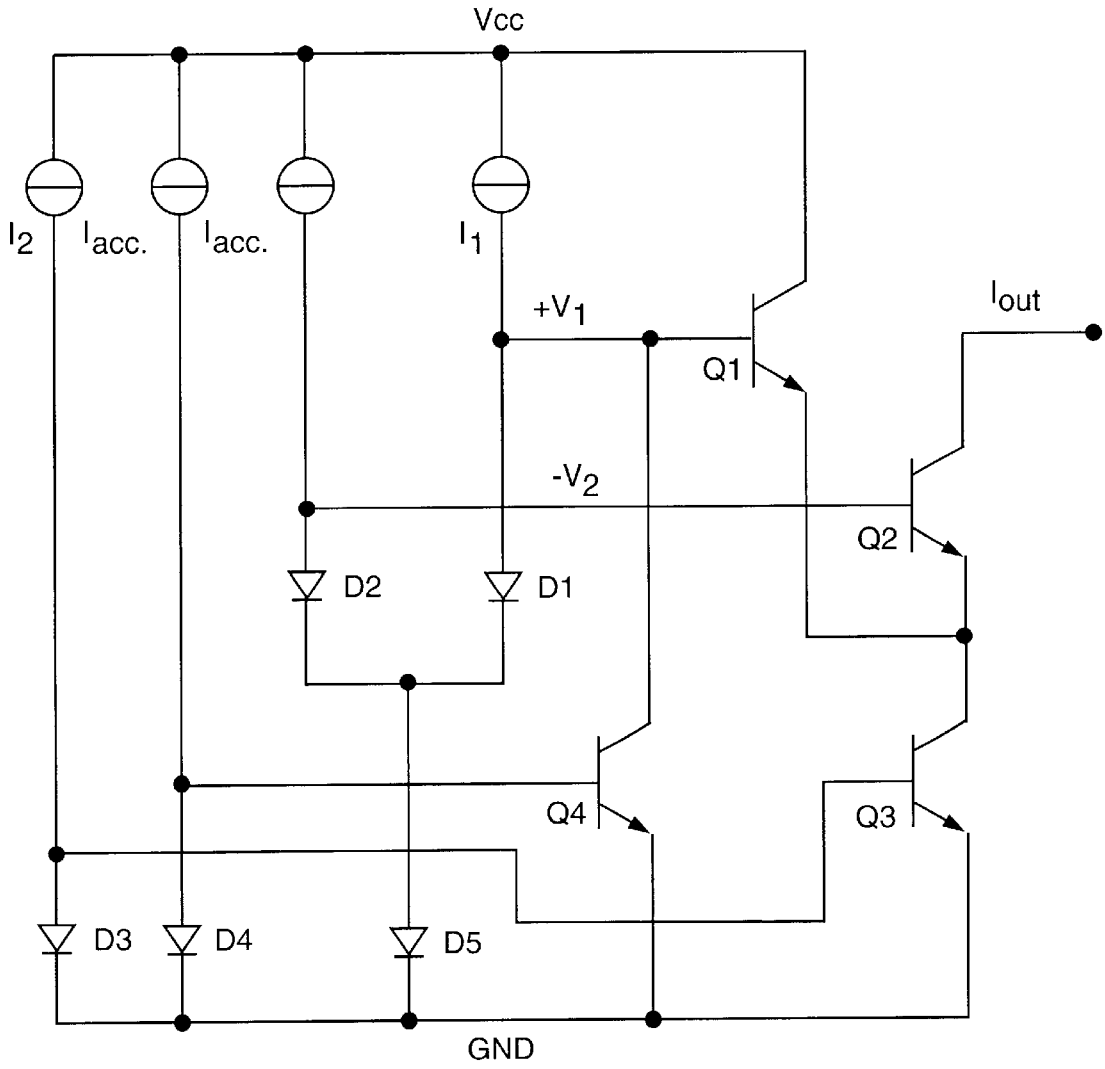
FIG. 4 is a multiplication and inverse circuit to perform multiplication and inversion to its input currents as practiced by this invention.

FIG. 4 illustrates a multiplication and inverse (MI) circuit (300) to perform multiplication and inverse to its input currents as practiced by this invention. The MI circuit, shown in FIG. 4, performs the function as described in Equation 4. The input currents, generated as previously described, are current mirrored for the input of this MI circuit. The $+V_1$ and $-V_2$ nodes are natural logarithmic voltages generated by D1 and D2 respectively. The difference between $+V_1$ and $-V_2$ is then derived by transistors Q1 and Q2, and this difference then creates the multiplication and inverse of the input currents. Current mirroring provides biasing for the MI circuit and is performed by diode and transistor pairs: D3 with Q3, and D4 with Q4.

Another Exemplary Embodiment—Controlling the Temperature Dependence Factor (TDF

In addition to having an accurate temperature-dependent current source, this invention also permits control of the temperature dependence according to the following method. In Equation 5, the constant parameters, RA, RB, $R_1$, $R_2$, k, q, and In(n), can be grouped into the variable $K_O$. This grouping is shown in Equation 6.

Equation 6:

$$I_{OUT} = \frac{2kTR_2R_A\ln(n)}{qR_1R_B} = K_oT$$

The temperature, T, in Kelvin, has a known constant added, and is expressed in terms of Celsius) by Equation 7.

Equation 7:

$$I_{OUT}=K_oT=K_o273.16+K_oT_C$$

The rate of change, or slope, relative to the constant term, $K_O273.16$, is expressed as the Temperature-Dependence Factor (TDF). The TDF of Equation 7 is then:

Equation 8:

$$TDF = \frac{K_o}{273.16\,K_o} = \frac{1}{273.16}$$

It is evident from Equation 8 that adjusting $K_O$ does not change the TDF. By adding or subtracting a constant current, the temperature dependence of the accurate current source can be affected, and this modification to Equation 8 is shown in Equation 9.

Equation 9:

-continued $$TDF = \frac{K_o}{273.16K_o + K_Z I_z} = \frac{1}{273.16 + \frac{K_Z}{K_o} I_Z}$$

In Equation 9, the $K_Z$ factor and the sign (+/−) of $I_Z$ can be modified to affect the TDF. The addition of a block to the architectural diagram of FIG. 2 accomplishes the changes found in Equation 9. The adjustment in TDF is shown in FIG. 5.

Figure 5:
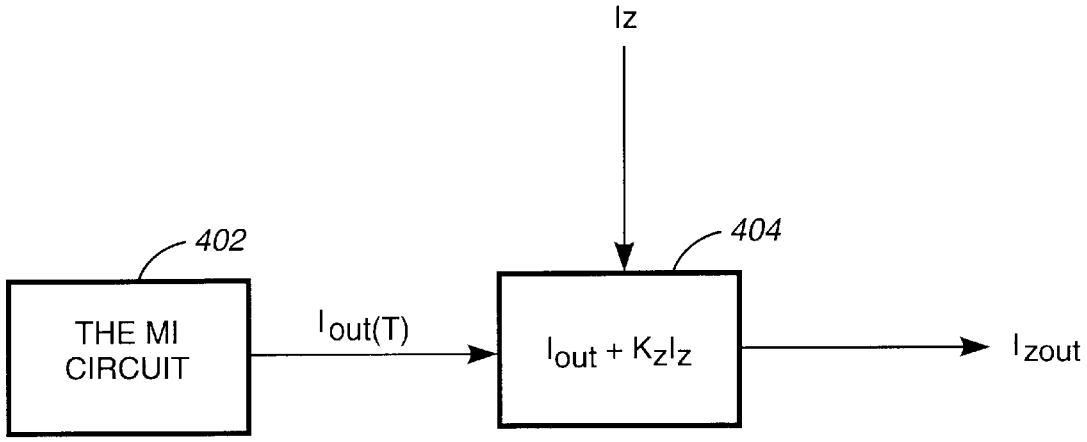
FIG. 5 is a block diagram of the architecture used to modify the temperature dependence as practiced by this invention.

FIG. 5 illustrates a block diagram of the architecture (400) used to modify the temperature dependence as practiced by this invention. The MI circuit (402) produces the accurate temperature dependent current Iout(T). The current, $I_Z$, is an accurate temperature independent current that is added or subtracted, depending on the desired TDF. The $K_Z$ factor is a simple gain or attenuation current mirror (404) that combines the currents, and would also depend on the desired TDF. Using Equation 7 and adding the new current, $I_Z$, and factor, $K_Z$, the following final equation for $I_{zOUT}$ is generated:

Equation 10:

IZOUT=Ko273.16+KoTc+KzIz

In Equation 9, the $K_Z$ factor and the sign (+/−) of $I_Z$ can be modified to affect the TDF. The addition of a block to the architectural diagram of FIG. 2 accomplishes the changes found in Equation 9. The adjustment in TDF is shown in FIG. 5.

FIG. 5 illustrates a block diagram of the architecture (400) used to modify the temperature dependence as practiced by this invention. The MI circuit (402) produces the accurate temperature dependent current Iout(T). The current, $I_Z$, is an accurate temperature independent current that is added or subtracted, depending on the desired TDF. The $K_Z$ factor is a simple gain or attenuation current mirror (404) that combines the currents, and would also depend on the desired TDF. Using Equation 7 and adding the new current, $I_Z$, and factor, $K_Z$, the following final equation for $I_{zOUT}$ is generated:

Equation 10:

IZOUT=Ko273.16+KoTc+KzIz

Therefore, an IC design has been described that avoids the limitations of the prior art requirement of two external resistors to provide temperature dependent and temperature independent circuits. Having one external resistor instead of two has lowered the cost and decreased the IC's physical size. Also, a means for controlling a temperature dependence factor has been described.

Although a specific embodiment of the invention has been disclosed, it will be understood by those having skill in the art that changes can be made to this specific embodiment without departing from the spirit and scope of the invention. The scope of the invention is not to be restricted, therefore, to the specific embodiment, and it is intended that the appended claims cover any and all such applications, modifications, and embodiments within the scope of the present invention.

What is claimed is:

1. A circuit for producing an accurate temperature dependent current source comprising:

a single external resistor;

an accurate temperature independent current source for producing an accurate temperature independent current dependent upon the single external resistor;

a bandgap reference circuit for generating an accurate bias current source and for generating an accurate reference voltage;

a first operational amplifier single rail type buffer and a second operational amplifier single rail type buffer to isolate the bandgap reference circuit from current generating circuits, each of the single rail type buffer having an output;

a second internal resistor; and a second temperature dependent current source for producing a second temperature dependent current source wherein the second temperature dependent current source is connected to the output of one of the single rail type buffer, wherein the second temperature dependent current source depends upon the second internal resistor.

2. The circuit as defined in claim 1, further comprising:

a first internal resistor; and a fourth current source in association with the accurate temperature independent current source, for producing a first temperature dependent current source wherein the fourth current source is dependent upon the first internal resistor.

3. The circuit as defined in claim 2, wherein a tracking tolerance of the first internal resistor and the second internal resistor is approximately 2 percent.

4. The circuit as defined in claim 2, wherein the first internal resistor and the second internal resistor are of the same type.

5. The circuit as defined in claim 4, wherein the internal resistors are compliant with integrated circuit technologies.

6. The circuit as defined in claim 2, wherein the accurate temperature independent current source further comprises an input wherein the input is connected to the output of a second one of the single rail amplifier buffers.

7. The circuit as defined in claim 6, further comprising:

a multiplication and inversion circuit to provide multiplication and inversion to three input currents the first temperature dependent current source, the second temperature dependent current source, and accurate temperature independent current thereby producing an accurate temperature dependent output current.

8. The circuit as defined in claim 7, wherein the accurate temperature dependent output current is only dependent upon a temperature (T), known constants (n), an amplification factor, a Boltzmann constant (k), and a charge of an electron (q).

9. The circuit as defined in claim 7, wherein the multiplication and inversion circuit further comprises a plurality of diodes and transistors.

10. The circuit as defined in claim 7, wherein the accurate temperature dependent output current has a temperature dependence factor.

11. The circuit as defined in claim 10, wherein the temperature dependence factor is adjustable by the addition or subtraction of a constant current that is multiplied by a factor Kz through a current mirror.

12. The circuit as defined in claim 11, wherein Kz represents a simple current gain or attenuation mirror.

* * * * *